United States Patent [19]

Suda et al.

[11] 4,072,412

[45] Feb. 7, 1978

[54] IMAGE TRANSFER DEVICE

[75] Inventors: Masashi Suda, Iruma; Shunichi Kubo, Tokyo, both of Japan

[73] Assignee: Canon Kabushiki Kaisha, Tokyo, Japan

[21] Appl. No.: 643,804

[22] Filed: Dec. 23, 1975

[30] Foreign Application Priority Data

| | | |
|---|---|---|
| Dec. 28, 1974 | Japan | 50-2500 |
| Dec. 28, 1974 | Japan | 50-2501 |
| Dec. 28, 1974 | Japan | 50-2502 |

[51] Int. Cl.[2] ..... G03G 15/16

[52] U.S. Cl. ..... 355/3 TR; 355/4

[58] Field of Search ..... 355/3 TR, 4, 3 R; 95/1.2, 1.4

[56] References Cited

U.S. PATENT DOCUMENTS

| | | | |
|---|---|---|---|
| 3,671,118 | 6/1972 | Fantuzzo et al. | 355/3 R |
| 3,697,168 | 10/1972 | Nisenson | 355/3 R |
| 3,729,311 | 4/1973 | Langdon | 355/4 |
| 3,773,417 | 11/1973 | Pressman et al. | 96/1.2 |

*Primary Examiner*—A. D. Pellinen

*Attorney, Agent, or Firm*—Fitzpatrick, Cella, Harper & Scinto

[57] ABSTRACT

An image transfer device, in which a developed image formed on an image-bearing member is transferred therefrom to a transfer medium, comprises a corona discharge device opposed to the image-bearing member for imparting corona discharge, a device for gripping the leading end edge of the transfer medium, a support extending between the corona discharge device and the image-bearing member and supporting the gripping device for circulatory movement, and an element for confining the path of the transfer medium gripped and guided by the gripping device substantially within the path of that device.

16 Claims, 13 Drawing Figures

IMAGE TRANSFER DEVICE

BACKGROUND OF THE INVENTION

1. Field of the Invention

This invention relates to an image transfer device for transferring electrophotographically formed and developed images to a transfer medium, and more particularly to such an image transfer device which can easily perform multicolor superposition transfers.

2. Description of the Prior Art

The known systems whereby developed images formed on a photosensitive medium may be transferred to a transfer medium include the system using a transfer roller to urge the transfer medium from the back thereof against the photosensitive medium, and the corona transfer system which utilizes corona discharge.

Color reproduction involves forming three or four different color images in superposed relationship with one another on a transfer medium and thus, requires image transfer to occur three or four times in order that a colored image may be transferred. During such image transfer, it is essential that no positional misregistration occur between the various color images transferred. For this purpose, there has been put into practice a system whereby a transfer medium may be securely wrapped about a transfer roller and used for a plurality of image transfers. See U.S. Pat. No. 3,612,677, for example.

In such transfer roller system, the contact of the transfer drum with the photosensitive medium has readily resulted in abrasion or pin-holes formed in the latter, which has in turn led to the likelihood of the life of the photosensitive medium being shortened.

Further, this system has suffered much from the risk of toner adhering to the surface of the transfer drum and when a different size of transfer paper is to be used, the back side of the transfer paper might readily become stained with the toner. To avoid this, a cleaner may effectively be provided to bear against the surface of the transfer drum to clean the same, whereas this would further require the provision of a cleaner control mechanism which would also lead to complication of the device. Moreover, if multicolor super-position transfer was effected with the transfer medium urged against the photosensitive medium by the transfer drum while an image transfer voltage being applied to the transfer medium, the image transfer field could not uniformly be imparted to portions of the transfer medium in which a developed image or images were already present, with a resultant tendency to aggravate the transfer efficiency of a subsequent image to be transferred. This has in turn led to an unsuccessful color balance between the superposed images transferred, which might also lead to a color image reproduction unfaithful to the original image. Furthermore, there has sometimes been the likelihood of giving rise to the hollowed phenomenon peculiar to the transfer roller, so called because the central part of a developed character image or the like failed to be transferred. The result might only be an incomplete color transfer. On the other hand, the corona image transfer is known to effect image transfer without the hollowed phenomenon taking place and has been put into practice for monochromatic reproduction, whereas no practical device capable of achieving good multicolor reproduction is known in the art to which the present invention pertains.

SUMMARY OF THE INVENTION

An object of the present invention is to provide an image transfer device which is capable of good corona image transfer.

Another object of the present invention is to provide an image transfer device which is capable of good multicolor superposition transfer onto transfer medium.

Generally described, the present invention, in causing developed imaged formed on an image-bearing member to be transferred to a transfer medium, is featurized by the provision of corona discharge means opposed to the image-bearing member for imparting corona discharge, gripper means for gripping the leading end edge of the transfer medium, support means extending between said corona discharge means and said image-bearing member and supporting said gripper means for circulatory movement, and transfer medium confining means for confining the path of the transfer medium gripped and guided by said gripper means substantially within the path of said gripper means.

Even if the image transfer to the transfer medium is repetitively effected by the construction of the present invention briefly described above and hereinafter explained in greater detail, almost uniform image transfer efficiency may be maintained to ensure good multicolor super-position transfer and accordingly, provide color reproduction with excellent color balance.

In addition, the gripper means gripping the transfer medium is moved by the support member which is circulatorily moved along a predetermined path, whereby good positional registration between images on the transfer medium may be maintained to enable color reproduction with excellent registration.

The invention will become more fully apparent from the following detailed description of some specific embodiments thereof taken in conjunction with the accompanying drawings.

FIG. *2a* is an enlarged view of the gripper mounting span portion of the same image transfer device.

FIG. *2b* is a side view of the transferring device illustrating the arrangement of the photosensitive member and the transfer material.

Figure 3:
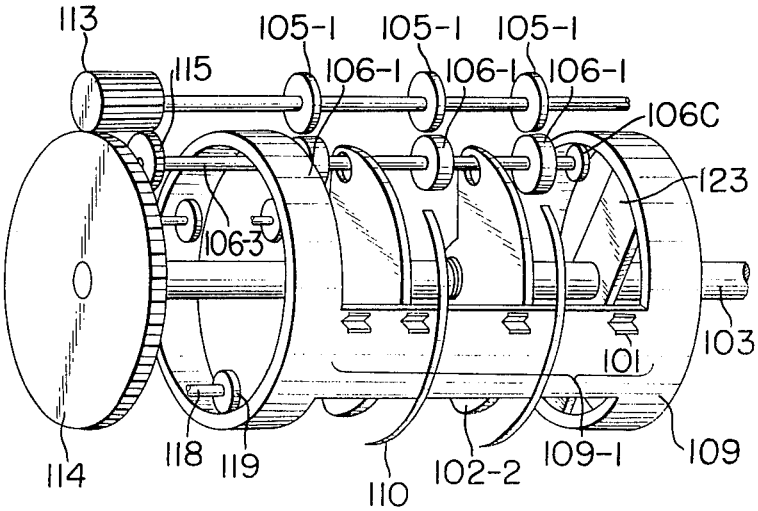

FIG. 3 is a perspective view of the image transfer device.

Figures 2, 2A:
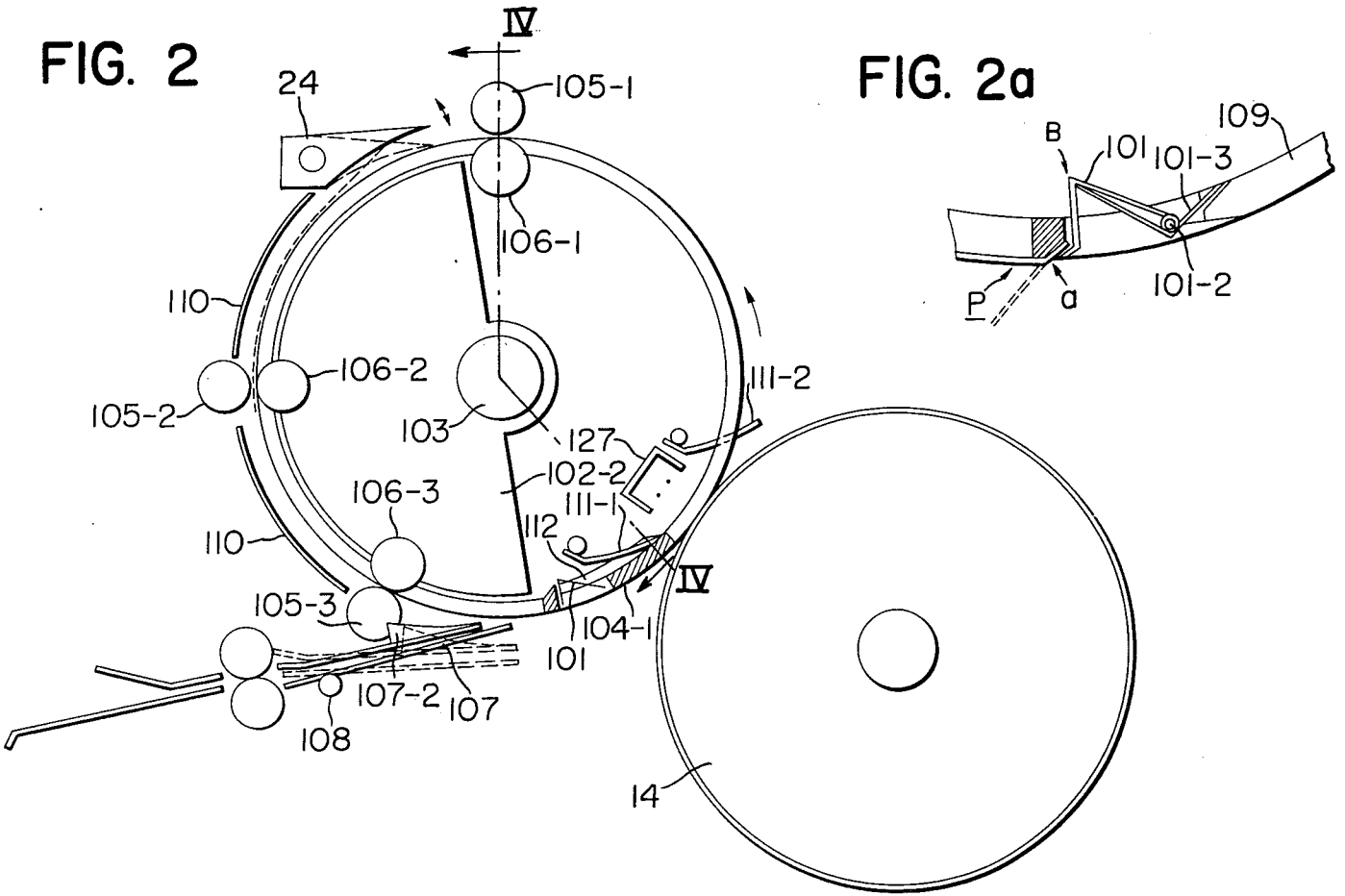
FIG. 2 is a side view of the image transfer device according to an embodiment of the present invention.
Figure 4:
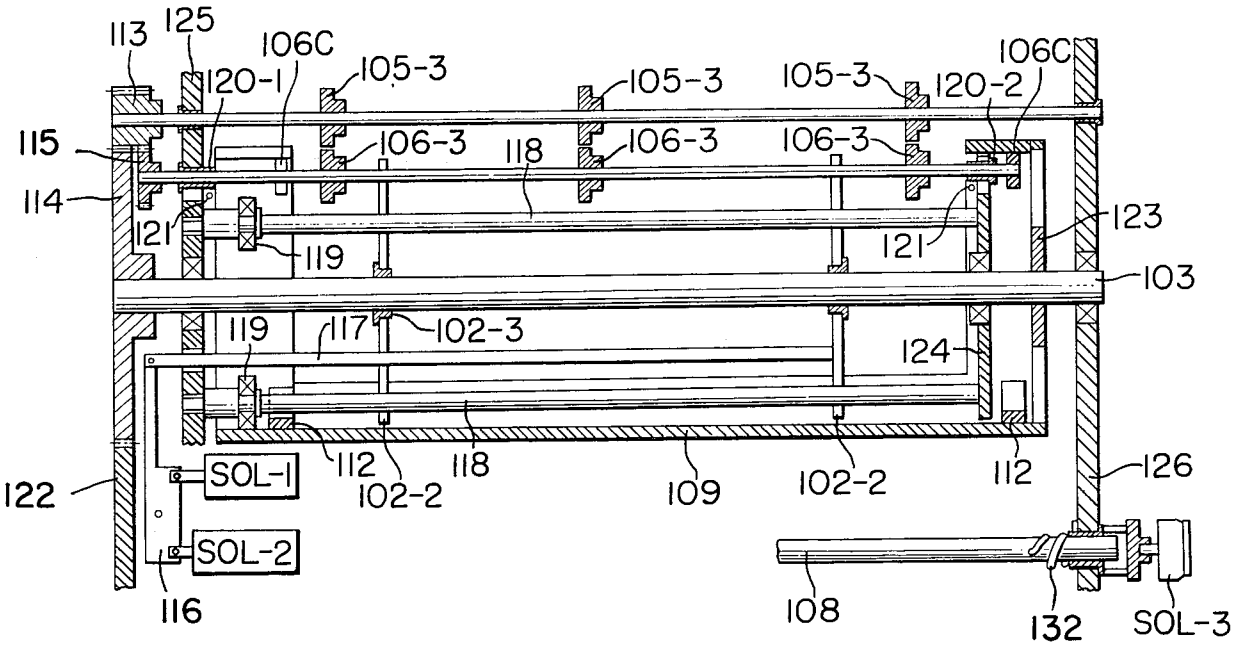

FIG. 4 is a cross-sectional view taken along line IV—IV in FIG. 2, and

FIG. *4a* is a partial perspective view of the transferring device shown in FIG. 4.

Figure 5:
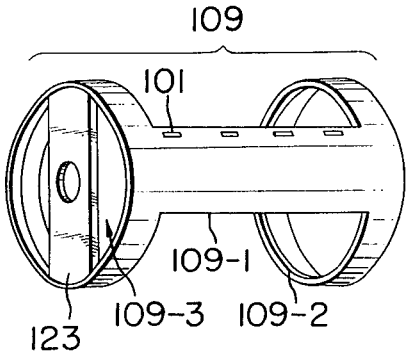

FIG. 5 shows, in perspective view, a form of the drum in which the gripper mounting span portion of the image transfer device is provided.

Figure 6:
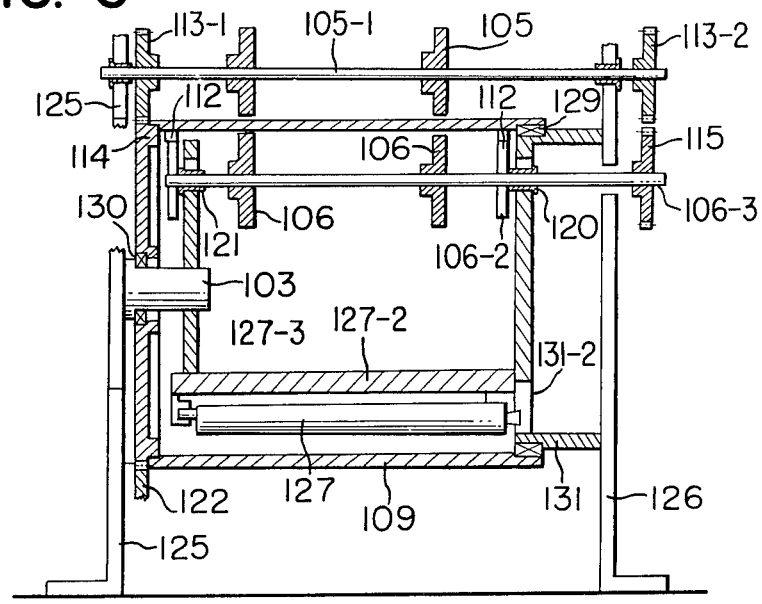

FIG. 6 is a cross-sectional view of the device according to another embodiment of the present invention.

Figure 7:
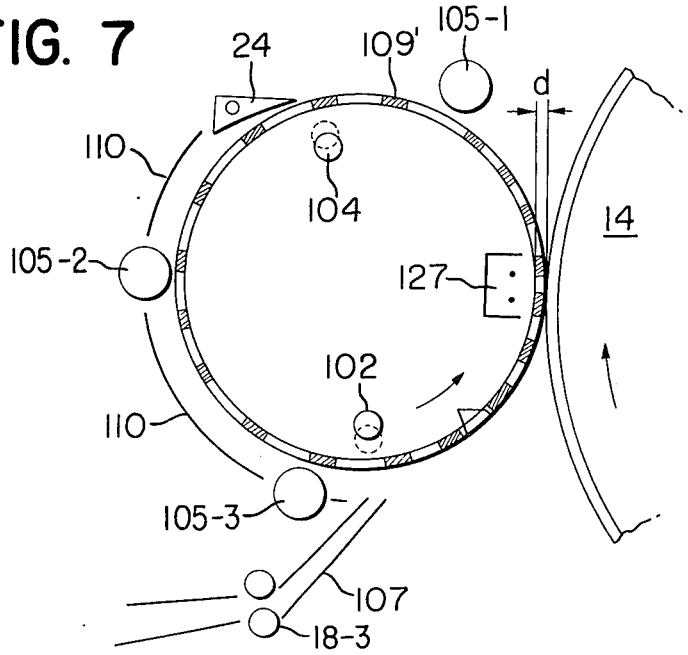
Figure 7A:
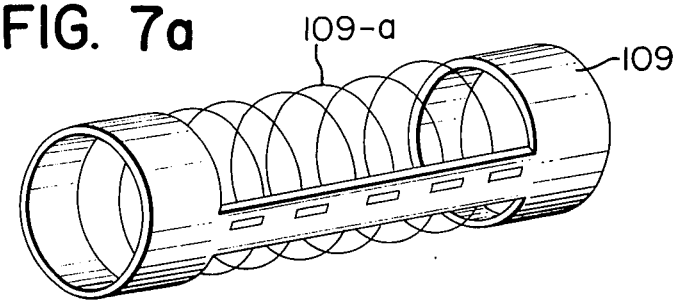
Figure 7B:
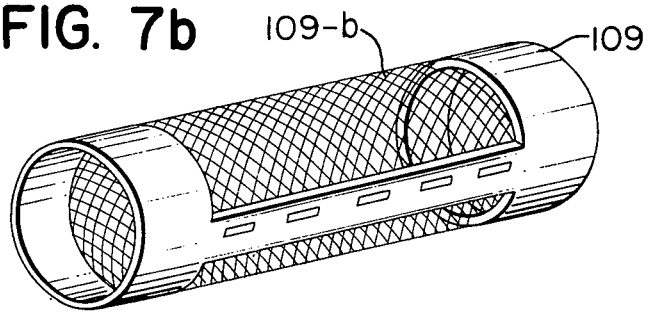
Figure 7C:
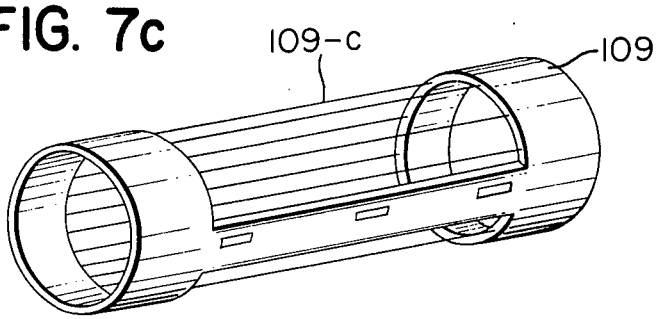

FIG. 7 is a side view of the device according to still another embodiment of the present invention.

FIGS. *7a* *7b* and *7c* show, in perspective view, still another forms of the drum.

DESCRIPTION OF THE PREFERRED EMBODIMENTS

Figure 1:
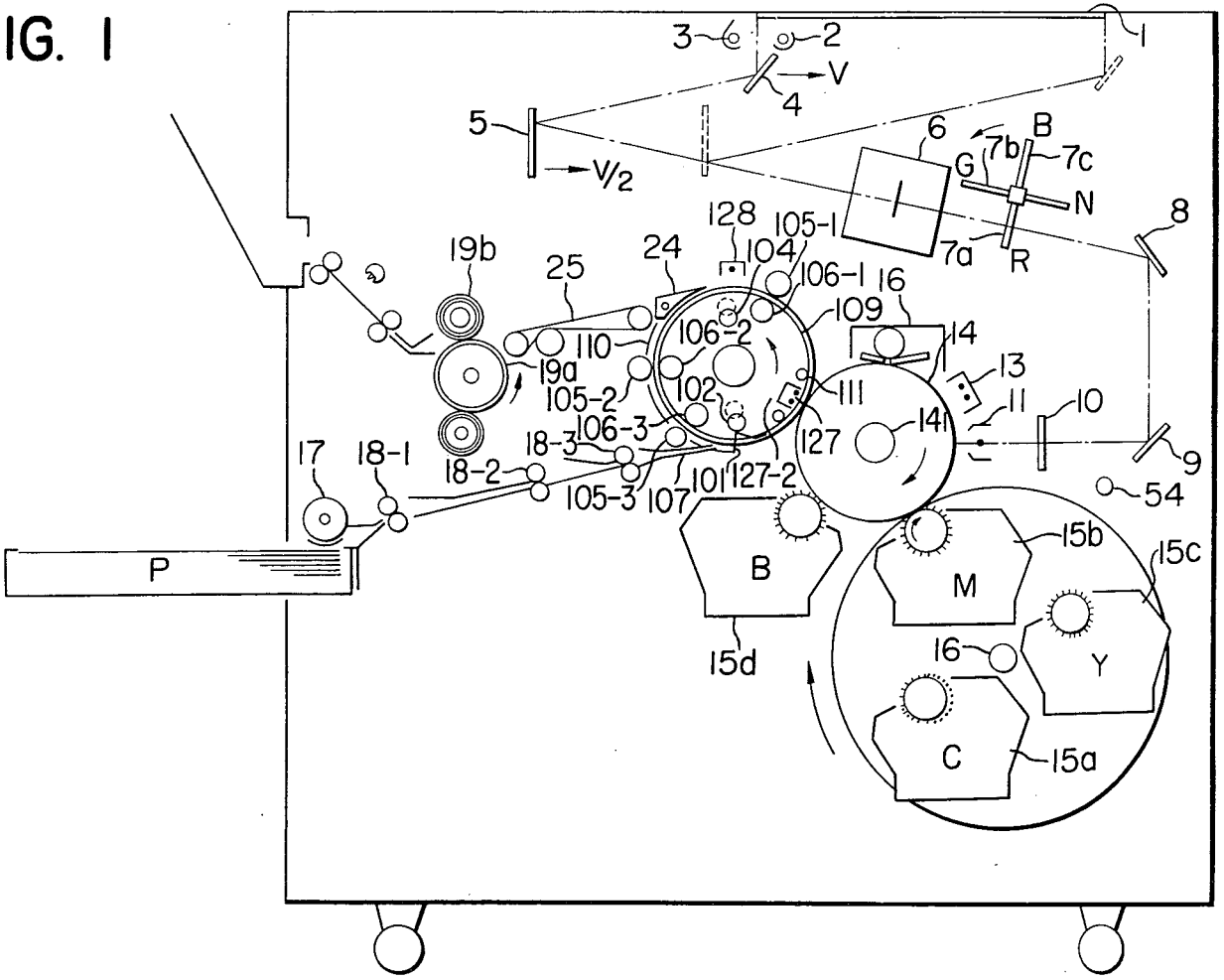
FIG. 1 is a side view of a copying apparatus to which the image transfer device of the present invention is applied.

Referring to FIG. 1, there is schematically illustrated a specific example of the electrophotographic color copying apparatus to which the image transfer device of the present invention is applied.

An original carriage 1 carries thereon an original which may be illuminated by an illuminating lamp 3 provided with a reflector shade 2. The light reflected by the original is scanned by a scanning optical system. The scanning optical system comprises a first scanning mirror 4 movable with the illuminating lamp, and a second scanning mirror 5 movable at half the velocity of movement of the first mirror 4.

The scanning mirrors are thus movable at the velocity ratio of 1:½, whereby they scan the original with the first half of the optical length of a lens system 6 remaining constant at all times. The reflected light image passes through the lens 6 to a color resolving filter 7. The color resolving filter 7 is such that any desired one of four different filters secured to a common shaft, namely, red R, green G, blue B and normal density Nd (for mono-chrome reproduction), is selectively moved into the light path. In color reproduction, the light image is color-resolved by one of the filters **7*a*, 7*b* and 7*c* corresponding to the three colors red R, Green G and blue B, and the light image so color-resolved is directed via a third 8 and a fourth mirror 9 and through a dust-proof sealing glass 10 so as to be focused on a photosensitive drum 14. The photosensitive medium may be of any suitable type and the formation thereon of electrostatic latent images may be carried out through any suitable process. In the illustrated example, the drum-shaped photosensitive medium 14 basically comprises an electrically conductive substrate, a photoconductive layer and an insulating layer, and the formation of electrostatic latent images on such photosensitive medium is based on the process disclosed in our U.S. Pat. No. 3,666,363 issued to Tanaka et al. The drum-shaped photosensitive medium 14, rotatably mounted on a shaft $14_1$, is rotated in the direction of the indicating arrow upon depression of a print button, and electrostatically charged by a primary charger 13 (to the positive polarity, for example), whereafter it is irradiated with the aforesaid color-resolved light image while being subjected to discharge by a discharger 11 opposite in polarity to the primary charge (e.g. the negative polarity), and further subjected to uniform allover illumination by an allover exposure lamp 54**, whereby there is formed an electrostatic latent image with high contrast on the photosensitive medium.

The electrostatic latent image so formed on the photosensitive drum 14 is then developed into a visible image by a developing device 15. The developing device 15 comprises four developing units **15*a*, 15*b*, 15*c* and 15*d* for cyan C, magenta M, yellow Y and black B, respectively, of which the units 15*a*, 15*b*, and 15*c* for C, M and Y supported for rotation about a shaft 16 and displaceable to the developing position while the unit 15*d* for black B is stationary. Therefore, when monochromatic or black-and white reproduction is desired, the stationary unit 15*d* is operated. When color reproduction is desired, a particular developing unit corresponding to a particular color-resolving filter (for example, the yellow developing unit 15*c* for the blue filter 7*c*) is rotated to the developing position to effect development of the formed image. A sheet of transfer paper P is fed from within a cassette into the apparatus by means of a paper feed roller 17, and with a first timing imparted thereto by a timing roll 18-1, the transfer paper P is further transported by a transport roll 18-2 and imparted a more precise timing by a timing roll 18-3, whereafter it is supplied to the image transfer device. The image transfer device is provided with a gripper movable along a circular circumference for gripping the transfer paper, as will hereinafter be described in greater detail. The gripper is movable around at a constant speed and may be opened by the action of a cam 102 at a position whereat the transfer paper comes to the image transfer device. Into the opening so provided by the gripper, the leading edge of the transfer paper is introduced. The gripper continues to move around and at a position whereat it comes out of engagement with the cam 102**, the gripper is closed to completely grip the leading end edge of the transfer paper.

Subsequently, the developed image on the photosensitive drum is transferred onto the transfer paper by an image transfer corona discharge as the transfer medium passes between an image transfer corona charger 127 and the photosensitive drum 14. For color reproduction, the gripper with the transfer medium P gripped thereby is caused to make three complete revolutions, thereby completing transfer of three colors in superposed fashion. Thereafter, a separating pawl 24 and a gripper actuating cam 104 are actuated. When the gripper is opened, the leading end edge of the transfer medium is released therefrom by the separating pawl and guided to a conveyor belt 25. The transfer medium is then guided to a fixing device comprising a pair of rollers **19*a* and 19*b*** having heat sources contained therewithin, so that the superposedly transferred images on the transfer medium are fixed thereon by heat and pressure.

In the meantime, after the transfer of the developed images, the surface of the photosensitive medium is cleaned by a cleaning device 16 having a resilient blade adapted to bear against that surface, and enters another cycle of image formation.

A specific embodiment of the image transfer device according to the present invention as applied in the abovedescribed color copying apparatus will now be described in particular. As shown in the side view of FIG. 2 and the perspective view of FIG. 3, the image transfer unit 109 comprises a drum having its side wall cut away except a gripper mounting span portion 109-1 to which the gripper 101 is attached. The unit drum 109 is engaged at one end with a rotary shaft 103 by means of a support plate 123 and supported at the other end by three rollers 119 rotatable in contact with the inner peripheral wall of the drum, so that the drum 109 is freely rotatable. Disposed within the drum is an image transfer corona discharger 127, conveyor rollers 106-1, -2, -3, pressure members 111-1, -2 adjacent to the image transfer corona discharger, and cams 102-1, -2, etc. for releasing the gripper. Disposed around the outer periphery of the unit drum are conveyor rollers 105-1, -2, -3, corresponding to those conveyor rollers within the drum, guide members 110 and separating pawl 24.

In the present embodiment, to assist in conveyance of the transfer paper, pairs of conveyor rollers provided at predetermined locations along the circular path followed by the transfer paper are rotated at a velocity substantially equal to the velocity of the transfer paper movement, namely, the rotational velocity of the drum 109. Further details will appear as the description of the operation progresses hereinafter.

The transfer paper, when supplied to the image transfer device, is first gripped by the gripper as shown in the enlarged view of FIG. 2*a*.

The gripper 101 is normally biased against the image transfer drum surface, namely, in a direction to pinch the transfer paper, by a torsion spring 101-3 supported on a shaft 101-2. On the other hand, the cam 102-2 disposed within the drum is movable in parallel to the rotary shaft 103 and when moved to its operating position, this cam pushes the point B of the gripper 101 which has come there with rotation of the image transfer drum. This causes the tip end of the gripper 101 to be projected outwardly of the surface of the image transfer drum at the paper supply position and thus, the gripper becomes ready to pinch the leading end edge of the transfer paper.

The leading end edge of the transfer paper, which has been supplied from the paper feed means in synchronism with the rotation of the image transfer drum, is inserted into the open space provided by the gripper 101. Further rotation of the image transfer drum brings the point B of the gripper out of the actuating position of the cam 102-2 so that the gripper tip end comes back inwardly of the drum to completely hold down the leading end edge of the transfer paper. With the rotation of the image transfer drum, the gripper portion passes between the image transfer corona discharger 127 and the photosensitive medium to guide the transfer paper to the image transfer position. Coming to the image transfer position, the transfer paper is widely brought into contact with the photosensitive medium by spring members 111-1 and 111-2 which spring away from the photosensitive medium so as to be spaced apart therefrom during the traverse of the gripper mounting span portion of the image transfer unit drum but act to urge the transfer paper against the photosensitive drum during the traverse of the other or opening portion of the unit drum, whereby image transfer may take place without non-uniformity. Also, these spring members, as shown, are secured to provide a spacing with respect to the traverse of the span portion 109-1 of the image transfer unit drum and can automatically spring away in accordance with the traverse of such portion, thus eliminating the need of adding any particular drive means. Also, the increased length of transfer resulting from the provision of such members leads to an advantage of enhanced transfer efficiency. By this, the gripper mechanism for gripping the leading end edge of the transfer paper may be prevented from being over-specialized in the function of guiding the transfer paper along a predetermined path during multicolor superposition transfer, so that each color image formed on the photosensitive medium may be transferred onto the same position on the transfer paper. It will be difficult to provide good registration between a purality of transferred color images unless, for the other portions of the transfer paper than the leading end edge thereof, the transporting force is achieved in such a manner that the electrostatic attraction to the transfer drum shifts successively from the leading to the trailing portions of the transfer paper with the rotation of the drum. It is therefore effective to employ a charger 127 of great width and to use the pressure springs 111 to urge the transfer paper against the transfer drum for a long time to thereby increase the electrostatic transporting force. Such pressure springs may preferably in the form of strip-like sheets of phosphor bronze or ferrous material, and about three of such springs will be sufficient for the transverse width of B4 format (364 mm). Such guide pressure springs 111 can be sufficiently effective at the locations off the photosensitive medium.

With the rotation of the image transfer drum, the transfer paper passes through the image transfer position to the separating position. For color reproduction, the gripper 101 is not released until a predetermined number of image transfers has been terminated. In other words, the cam 102-2 remains away from the position for actuating the gripper. Thus, the transfer paper is again guided to the image transfer position.

When the transfer medium is a highly insulative member such as, for example, a transparent sheet for OHP (overhead projection), repeated image transfer for color reproduction will cause the transfer medium having once passed by the image transfer corona charger to remain charged thereafter and this will impede the effect of a subsequent image transfer field. In such a case, sequentially increasing the image transfer corona discharge voltage will also be effective, but it will require the use of a voltage control mechanism which will in turn mean a complicated control operation.

In the embodiment of the device according to the present invention now under discussion, a charger 128 is provided at a location along the path of the gripper 101 and subsequent to the transfer corona discharger 127, as seen in FIG. 1. The charger 128 applies either a voltage opposite in polarity to that of the transfer corona discharger 127 or an AC voltage to eliminate any surface potential change which change may otherwise result due to operation of the discharger 127 on the transfer medium. This enables uniform multicolor transfer. Particularly, if the charger 128 is located upstream of the separating position to act on the transfer medium before separated, it will be possible to obviate such inadvertent occurrences as the transfer medium being abnormally electrostatically attracted to the transport guide during transport and after separation, or discharge occurring to the transport guide or similar conductive member around the transport path to disturb the transferred image.

As seen in FIG. 2 which shows the image transfer device, each pair of rollers 105-1, 106-1; 105-2, 106-2; 105-3, 106-3 confine therebetween an ungripped portion of the transfer paper to prevent random movement thereof after the gripping mechanism has passed through the clearance between the pair of rollers. The clearance between each pair of rollers may preferably be greater than the thickness of the transfer paper and is allowable up to the order of 6 mm. The material of the inner rollers 106-1, -2, -3 may be selected without their effection the image being taken into account because these rollers make no direct contact with the developed image on the transfer paper, whereas if these are rollers of grounded conductor or metal, the toner image on the surface of the transfer paper might possibly be exploded when the ambient humidity is very low. In view of this, and also in terms of the friction force useful for the paper transport, the inner rollers may suitably be formed or rubber and further suitably, be knurled. The outer rollers 105-1, -2, -3, which can sometimes contact the developed image on the transfer paper, may be formed of non-adhesive material such as Teflon, Delrin or Rulon (tradenames), or may be metallic rollers imparted with a high potential of the same polarity as the toner used. After the entire transfer paper has left the pair of rollers 105-1 and 106-1, the transfer paper moves, as indicated by the dotted line depicting an arc with the clearance between the rollers 105-2 and 106-2 as a knot, with only the trailing end thereof contacting the pawl 24 having an arcuate web portion. Since it is only the trailing end edge of the transfer paper that moves while making sliding contact, the transferred image may never be destroyed. Likewise, the transfer paper moves along the guide 110 with only the trailing end edge thereof contacting the guide and further, the trailing end edge leaves the pair of rollers 105-3 and 106-3.

The trailing end edge of the transfer paper then shifts to a position on a guide 107-2 corresponding to the position on said other guide 110, the guide 107-2 being attached to the upper surface of the paper feed guide 107 which has been displaced to the dotted-line position by a plunger or like means after the paper supply was terminated.

With the rotation of the image transfer drum, the transfer paper is subjected to a predetermined number of image transfers. After such repetitive image transfer is terminated and when the gripper portion of the image transfer drum reaches the separating position, the gripper 101 is released by the same action of the cam 102-2 as that described with respect to the paper supply position.

On the other hand, the separating pawl 24 having so far been in the solid-line position in FIG. 2 is displaced to the broken-line position, thus being ready to wedge in between the leading end edge of the transfer paper, now floated up by the release of the gripper, and the surface of the image transfer drum, thereby separating the transfer paper from the drum surface.

As is particularly shown in FIG. 2*a*, that portion of the drum which is struck by the tip end of the gripper for holding down the leading end of the transfer paper may be cut away obliquely with respect to the drum surface, whereby the transfer paper may suddenly be bent at the point *a*. By this, there may be created in the paper a force which tends to cause the paper to assume the dotted-line position due to the self-supporting force of the paper, so that the leading end of the paper may be urged against the photosensitive drum, and upon release of the gripper, the leading end edge of the transfer paper will jump up from its self-supporting force with the point *a* as a knot. This is advantageous both for the separation and the image transfer.

The circumference/radius of such a transfer unit drum may be equal to that of the photosensitive drum or may be selected to an integral ratio to the latter. In addition, a gear 122 having a pitch diameter substantially equal to the circumference/radius of the photosensitive drum may be mechanically connected directly to a gear 114 having a pitch diameter substantially equal to the circumference/radius of the image transfer unit drum. By this, the point *a* may follow a predetermined circular path for each of the plurality of image transfers and be positionally registered exactly in synchronism with the leading end of each developed image on the photosensitive medium, so that the point *a* will mechanically contact the photosensitive drum with the transfer paper intervening therebetween. Thus, there may be obtained transferred images which are entirely free of misregisteration. Also, experiments show that the cutaway near the point *a* may preferably be formed at an angle of inclination $\theta$ ranging from 0° to 30° with respect to the tangent with the drum surface, in which case the leading end portion of the transfer paper is uniformly rectilinearly urged against the photosensitive drum without the transferred image in the leading end portion being disturbed, thus achieving the so-called sharp cut at the leading end edge of the image. Such factor is variable with paper thickness. For ordinary paper (60 to 80 g/m$^2$), an angle of 20° or so is suitable and for thicker paper (above 80 g/m$^2$), a smaller angle is preferable. A greater value of the angle $\theta$ than the optimum value would increase the rate at which the leading end portion of the transfer paper so far held down raises itself at the point due to the self-supporting force thereof when it has left the image transfer position. This would cause positional misregistration and accordingly, color misregistration, of the images.

Figure 2B:
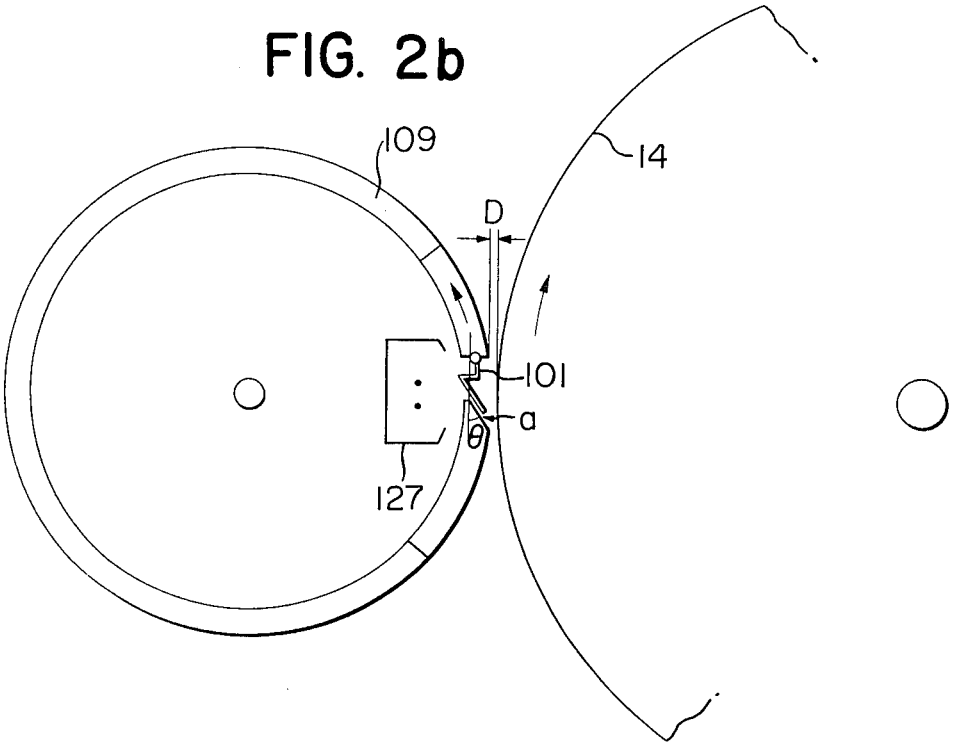

Also, any mechanical contact of the point *a* with the photosensitive drum through the transfer medium might damage the surface of that drum. It is therefore preferable to provide a gap (FIG. 2*b*). However, too great a gap would cause irregularity in the position of the leading end when contacting the photosensitive medium, which would in turn cause color misregistration. In practice, color misregistration on the transfer paper will be tolerable if it is within 0.15 mm. Experiments show that even when the point *a* does not contact the photosensitive drum through transfer paper, no color misregistration occurs if the gap does not exceed 1.2 mm. When this limit was exceeded, the initial position of contact of the transfer paper with the photosensitive drum was not constant under adverse conditions, namely, when the humidity was high or when the transfer paper was thick (above 80 g/m$^2$), with a result that color misregistration readily occurred. Thus, it is very important to limit the gap between the point *a* and the photosensitive medium to a proper value or less in order to realized good image transfer.

The device of the present embodiment will further be described by reference to FIG. 4 which is a cross-section view thereof. The drum of the image transfer unit 109 is engaged with the shaft 103 by means of a support plate 123, and a gear 114 is securely mounted on the shaft 103. The gear 114 meshes with a gear 122 coaxially coupled to the photosensitive medium (not shown). By selecting the gear ratio to a predetermined integral ratio as already described, the synchronization of the image transfer unit with the rotation of the photosensitive drum 14 may be provided to enable superposed image transfers to occur at the same position on the transfer paper.

Figure 4A:
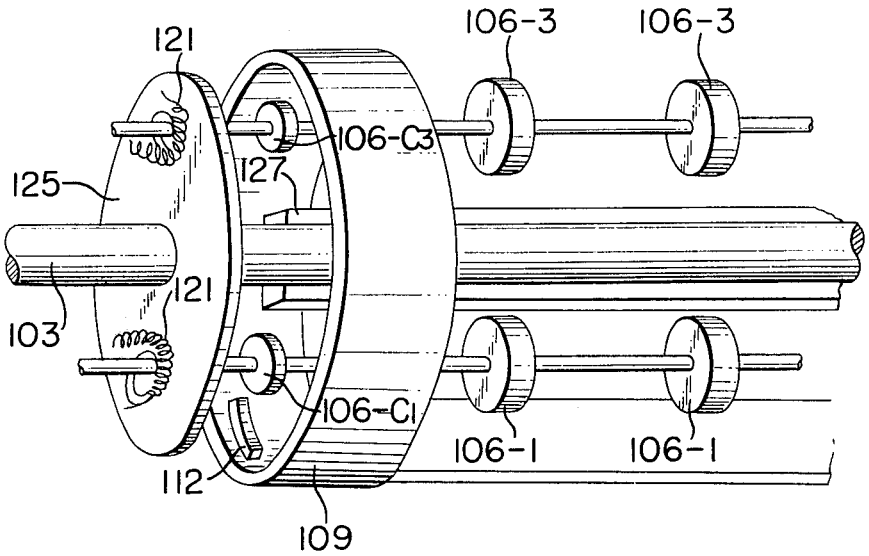

In the device according to the present invention, various mechanisms such as gripper actuating cams, inner conveyor rollers 106-1, -2, -3 for confining the transfer paper and charger 10 are mounted within the transfer unit 109 and this means that a special supporting method is necessary for the cylindrical transfer unit. In the present device, three shafts 118 secured to one side plate of the apparatus and rollers 119 rotatably mounted on these shafts support the inner peripheral wall of the transfer unit for the purpose of providing a drive to the inner conveyor rollers and for the purpose of locating the gripper actuating cam moving mechanism outwardly of the unit. The other end of the transfer unit is secured to the center shaft 103 by means of the plate 123, the shaft 103 being rotatably journalled to the side plates of the apparatus by means of bearings. Thus, the drive of the gear 114 may be integrally transmitted to the transfer unit 109. Also, through the space other than that occupied by the rollers 119 and the center shaft 103, the shafts for the inner conveyor rollers 106-1, -2, -3 may be projected outwardly of the side plates, so that these inner conveyor rollers may be driven by the gear 113 which rotatively drives the outer conveyor rollers 105-1, -2, -3. Since the outer peripheries of the inner conveyor rollers 106-1, -2, -3 lie near the outer periphery of the transfer unit, these rollers should be so designed that they do not interfere with the span portion 109-1 of the transfer unit as the latter traverses said rollers. For example, a cam 112 is provided on the inner peripheral wall of the drum in corresponding relationship with the span portion so that, when a roller 106-C comes to ride on this cam, a gap greater than the thickness of the span portion may be provided between the rollers 105 and 106. After the span portion has traversed, the roller 106-C may be returned from the cam to its original position by the resiliency of a spring 121. Such mechanism is more particularly shown in the perspective view of FIG. 4*a*. A mechanism entirely similar to this may be used instead of the leaf springs 111-1, -2 shown in FIG. 2, to advance and retract an auxiliary transfer roller such as the roller 111 shown in FIG. 1. At this time, the bearing 120-1 supporting one end of the inner roller shaft is in engagement with the side plate 125 while the bearing 120-2 supporting the other end of said roller shaft is in engagement with an auxiliary side plate 124 cantilevered from the side plate 125 by a stay 118 against rotation with respect to the center shaft. Although not shown, the charger rail 127-2 of FIG. 1 is also used as a stay for connecting the auxiliary side plate 124 to the side plate 125, and the charger 127 may be inserted and withdrawn through the clearance between the plate 123 and the inner periphery of the transfer unit. A socket to which a high voltage is supplied may be mounted between the gear 114 and the side plate 125 and on the latter.

Adhesion of transfer paper to a roller results from the electrostatic force acting between the charge in the toner and that in the transfer paper and can therefore resist the force acting in the direction of thickness of the transfer paper but is very weak against the force acting in a direction perpendicular to the thickness of the paper, namely, the force in the direction of sliding movement. Therefore, any relative sliding movement caused between the roller and the transfer paper would readily destroy the transferred image. In the present device, however, the inner and outer conveyor rollers are mechanically stably driven, thus preventing the toner image disturbed. Also, even if there is caused any variation in the load of the transfer unit, the spacing between the pairs of rollers which are guiding the transfer paper prevents any load from being imparted to the transfer paper, so that the paper can be stably transported with the aid of the electrostatic force acting between the paper and the photosensitive medium. In the case of thick paper, (namely transfer paper with a great self-support strength say, 80 g/m$^2$ or more), it has been found that no inconvenience is encountered even in the absence of the inner rollers 106-1, -2, -3. A similar effect has been obtained when the outer rollers 105-1, -2, -3 were omitted and the guide 110 was extended along substantially one half of the entire circumference of the unit drum on that side where the transfer paper moves downwardly (the left-hand side in FIG. 1). In this latter case, the guide 110 may be in the form of a strip and three of such strips are enough to provide a sufficient effect for the width of B4 format (364 mm). The material of the guide may be non-adhesive material (Teflon or the like), metal or plastics.

Where the transfer paper is to be guided so as to depict the same path as that depicted by the gripper as described, there will be encountered an inconvenience if the transfer paper is ordinary paper. More specifically, where there is no guide member within the transfer unit, the trailing end of the transfer paper may fall to become jammed or otherwise entangled at the image transfer corona means or the like.

Such accident may be eliminated if a guide is provided within the transfer unit but off the path of the gripper. In this case, the trailing end of the transfer paper will move along the guide, but the transfer paper will undergo a load which will resist the force with which the paper is driven and transported by the gripper. This makes it difficult to maintain a constant area of image transfer and carry out the image transfer in a stable manner, and color misregistration may result. This is conceivably attributable to the difference in locus between the leading and the trailing end of the transfer paper which may result in differences in velocity of movement between successive portions of the transfer paper and may accordingly result in a great load. In the present embodiment of the invention wherein the transfer paper is guided along the path of the leading end thereof, no irregularity occurs particularly in the movement velocity of the transfer paper and this ensures good transport with a less load involved.

In this manner, the transfer paper does not undergo too great a load and this leads to realization of image transfer free of color misregistration. The effectiveness of the guide rollers rotatable at a velocity equal to the movement velocity of the transfer paper and provided along the path of the paper to assist in the movement thereof will also be appreciated.

In a color copying apparatus like that now under discussion, the gripper actuating cam 102-2 must be such that it is opened to grip the leading end edge of the transfer paper during the first paper feed, whereafter it escapes to a position in which it is never opened until three image transfers are completed. Such escape of the gripper can easily be accomplished by the adoption of the above-described transfer unit supporting method which enables the cam 102-2 to slide on the center shaft with the aid of the bearing 102-3. More particularly, in order to permit sliding movement of the gripper actuating cams 102-2 corresponding in number to the grippers 101, the stay 117 on which the cams are mounted between the rollers 106-2 so as to be projected outwardly of the side plate 125 and an arm 116 is attached to the projected end of the stay, which arm may be actuated by solenoids SOL-1 and SOL-2 to move the stay 117 to thereby move the cams 102-2 to their gripper actuating positions and to their non-actuating positions. The outer rollers 105-1, -2, -3 are supported to the side plates 125 and 126 by means of bearings and are situated so as not to contact the span portion of the transfer unit as it treverses the rollers. Thus, the peripheral velocity of the roller pairs 105-1, -2, -3 and 106-1, -2, -3 can be maintained equal to that of the transfer unit. Usually, the paper feed guide 107, which is also the last one for guiding the image-bearing transfer paper, is mounted on the shaft 108 as shown in FIG. 4, and after the trailing end of the paper has left it, the guide 107 is pivoted by a rotating solenoid SOL-3 so that the guide 107-2 attached to the back surface of the guide 107 may be set to a position for guiding the transfer paper. Thus, the guide 107 serves a function similar to that of the guide 110. In the present invention, the return of the pivoted guide 107 to its paper feeding position may be accomplished by a torsion spring 132. The operating signal therefore may of course be used either in association with a copy print switch or produced by an independent cam switch, as desired.

FIG. 6 illustrates another specific embodiment in which the image transfer unit is supported by a different method. With this method, the center shaft may be made stationary independently of the transfer drum or even eliminated. The transfer unit 109 has one end supported by a bearing 129 fitted over a member 131 secured to a side plate 126, and has the other end rotatably supported by a bearing 130 fitted on the shaft 103 secured to a side plate 125. A rail 127-2 for mounting thereon a charger is secured to the members 131 and 127-3 supported by the opposite side plates, and the charger may be inserted and withdrawn through an aperture 131-2 formed in the member 131.

The inner rollers 106 are shown in their positions spaced apart from the rollers 105. Such spacing means that the span portion of the transfer unit is just traversing between these rollers and that the roller 106-2 rotatably mounted on the shaft 106-3 of the inner rollers 106 has come to ride on the cam 112 provided on the inner peripheral wall of the transfer unit. The inner rollers 106 are securely mounted on the shaft 106-3 for rotation therewith. The shaft 106-3 is projected from within the transfer unit outwardly of the side plate 126 and the projected end of the shaft has a gear 115 mounted thereon.

A shaft 105-1 having the outer rollers 105 securely mounted thereon is rotatably journalled to the side plates 125 and 126. Gears 113-1 and 113-2 are provided on the shaft 105-1 for meshing engagement with gears 114 and 115 mounted on the opposite sides of the transfer unit, respectively. With the rotation of the transfer unit 109, the outer rollers 105 are rotatable but in FIG. 6, the inner rollers 106 are not in rotation because the gear 113-2 is out of engagement with the gear 115. After the cam 112 traverses the roller 106-2, the shaft 106-3 comes closer to the outer roller shaft to bring the gear 115 into engagement with the gear 113-2 so that the outer rollers 106 resume rotation at a predetermined velocity as already described in connection with the previous embodiment.

With this supporting method, the center shaft of the transfer unit may be eliminated to provide a sufficient space within the transfer unit and this is advantageous for reducing the size of the device.

FIG. 7 is a side view showing a further embodiment of the device according to the present invention. The surface 109' of the transfer unit drum is formed with a number of openings through which the corona ions from a corona discharger 127 disposed within the drum may sufficiently act on the transfer paper to permit easier transport of the transfer paper. As an alternative to such openings formed in the drum itself, the drum may of course take the form as shown in FIG. *7a* wherein filament-like guide members 109-a are provided circumferentially of an opening formed in the drum which is substantially coextensive with the entire area of the transfer paper, or the form as shown in FIG. *7b* wherein a grid-like guide member 109-b extends over a similar opening. Also effective will be the construction as shown in FIG. *7c* wherein a plurality of straight guide lines 109-c extend parallel to the axis of the drum and over the opening longitudinally thereof.

Metal employed as the material for the apertured drum member or the guide member would be satisfactory in strength, and a better result would be provided if a bias voltage of the same polarity as the voltage applied to the corona discharger 127 is applied to such member to assist in the action of the image transfer corona.

Insulative resin material may also advantageously be utilized for said member. In this case, application of the bias voltage is unnecessary and the image transfer corona is only required to charge up the surface of the member, whereafter it may sufficiently act on the transfer paper.

The insulative material so charged up permits particularly ready adhesion of toner particles which would stain the back side of the transfer paper and in view of this, a predetermined distance *d* should preferably be maintained with respect to the photosensitive medium.

On the other hand, in order to ensure effective action of the corona image transfer, the distance *d* should desirably be smaller, and if the voltage is to be applied to a conductive material, the distance may preferably be within about 3 mm. Empirically, a distance *d* of the order of 1 mm for an applied voltage of 1KV has been found satisfactory.

The device of the present invention, as will be appreciated from the foregoing, achieves good transfer of images and also realizes good registration between the transferred images.

Moreover, the image or images on the transfer medium when being transported for repeated image transfers are never disturbed, thus providing good color reproduction.

What is claimed is:

1. An image transfer device for causing developed images formed on an image-bearing member to be transferred therefrom to a transfer medium, said device comprising:

corona discharge means opposed to said image-bearing member for imparting corona discharge;

gripper means for gripping the leading end edge of said transfer medium;

support means extending between said corona discharge means and said image-bearing member and supporting said gripper means for circulatory movement; and transfer medium confining means for confining the path of the transfer medium gripped and guided by said gripper means substantially within the path of said gripper means, said transfer medium confining means including at least one set of confining roller pairs disposed with the path of said gripper means intervening therebetween.

2. An image transfer device according to claim 1, wherein said pairs of rollers are rotatable at a velocity equal to the velocity of movement of said gripper means.

3. An image transfer device according to claim 1, wherein at least one of said pairs of rollers is displaceable out of the path of said gripper means when the latter traverses the former.

4. An image transfer device for causing developed images formed on an image-bearing member to be transferred therefrom to a transfer medium, said device comprising:

corona discharge means;

a drum supported for rotation about the axis thereof and containing therewithin said corona discharge means, said drum having an opening formed in the side wall thereof for permitting the corona discharge to act therethrough;

gripper means provided on said drum for gripping the leading end edge of said transfer medium; and transfer medium confining means for confining the path of the transfer medium gripped and guided by said gripper means substantially within the path of said gripper means, said transfer medium confining means comprising first transfer medium confining members disposed within said drum and outwardly displaceable in said opening of said drum, and second transfer medium confining members disposed along the outer periphery of said drum.

5. An image transfer device according to claim 4, wherein at least one of said first transfer medium confining members is a movable roller.

6. An image transfer device according to claim 5, wherein said movable roller is rotatively driven in said opening at a velocity equal to the peripheral velocity of said drum.

7. An image transfer device according to claim 4, wherein at least one of said second transfer medium confining members is a movable roller.

8. An image transfer device according to claim 7, wherein said movable roller is rotatable at a velocity equal to the peripheral velocity of said drum.

9. An image transfer device according to claim 4, wherein at least one of said second transfer medium confining members is a stationary guide plate.

10. An image transfer device according to claim 4, wherein at least one of said second transfer medium confining members is a paper feed guide plate.

11. An image transfer device according to claim 4, further comprising means disposed within said drum and adjacent to said corona discharge means for pressing said transfer medium against said image bearing member.

12. An image transfer device according to claim 11, wherein said pressing means comprises a spring member.

13. An image transfer device according to claim 11, wherein said pressing means comprises a movably mounted roller.

14. An image transfer device for causing developed images formed on an image-bearing member to be transferred therefrom to a transfer medium, said device comprising:

corona discharge means;

a drum supported for rotation about the axis thereof and containing therewithin said corona discharge means, said drum having an opening formed in the side wall thereof for permitting the corona discharge to act therethrough;

gripper means provided on said drum for gripping the leading end edge of said transfer medium; and transfer medium confining means for confining the path of the transfer medium gripped and guided by said gripper means substantially within the path of said gripper means, said transfer medium confining means comprising first transfer medium confining members disposed at said opening of said drum, and second transfer medium confining members disposed along the outer periphery of said drum.

15. An image transfer device according to claim 14, wherein said at least one of second transfer medium confining members is a movable roller.

16. An image transfer device according to claim 14, wherein said first transfer medium confining members are filament-like guide members.

* * * * *

UNITED STATES PATENT OFFICE

CERTIFICATE OF CORRECTION

Patent No. 4,072,412 Dated February 7, 1978

Inventor(s) MASASHI SUDA, SHUNICHI KUBO

It is certified that error appears in the above-identified patent and that said Letters Patent are hereby corrected as shown below:

Column 8, line 11, after "point" insert --a --.

Column 11, line 20, after "the" insert --outer--.

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*